United States Patent [19]

Hoshino et al.

[11] Patent Number: 4,501,465

[45] Date of Patent: Feb. 26, 1985

[54] THREE-PIECE MULTICONNECTOR

[75] Inventors: Mitsuo Hoshino, Atsugi; Osamu Fukushima, Kawasaki; Toshio Kakuta, Higashiosaka, all of Japan

[73] Assignees: Sony Corporation, Tokyo; Hosiden Electronics Co., Ltd., Osaka, both of Japan

[21] Appl. No.: 443,089

[22] Filed: Nov. 19, 1982

[30] Foreign Application Priority Data

Nov. 30, 1981 [JP] Japan ..... 56-178549[U]

[51] Int. Cl.[3] ..... H01R 13/50

[52] U.S. Cl. ..... 339/176 MP; 339/206 R; 339/218 M

[58] Field of Search ..... 339/176 MP, 206 R, 206 P, 339/218 R, 218 M

[56] References Cited

U.S. PATENT DOCUMENTS

| | | | |
|---|---|---|---|
| 3,525,972 | 8/1970 | Asick et al. | 339/206 R |
| 3,594,699 | 7/1971 | Jayne et al. | 339/176 MP |
| 3,646,504 | 2/1972 | Classon | 339/176 MP |
| 3,710,303 | 1/1973 | Gallager, Jr. | 339/176 MP |
| 3,798,587 | 3/1974 | Ellis, Jr. et al. | 339/210 M |
| 4,087,148 | 5/1978 | Baucerle | 339/176 MP |
| 4,127,317 | 11/1978 | Tyree | 339/176 MP |
| 4,221,458 | 9/1980 | Hughes et al. | 339/176 MP |
| 4,269,467 | 5/1981 | Hughes | 339/218 M |
| 4,395,084 | 7/1983 | Conrad | 339/176 MP |

FOREIGN PATENT DOCUMENTS

| | | | |
|---|---|---|---|
| 557098 | 12/1974 | Canada | 339/176 MP |

*Primary Examiner*—John McQuade
*Assistant Examiner*—Gary F. Paumen
*Attorney, Agent, or Firm*—Pollock, Vande Sande and Priddy

[57] ABSTRACT

A multiconnector includes a body composed of first, second and third blocks, the first and second blocks being joined at their ends with an insertion slot being defined therebetween for insertion therein or removal therefrom of a companion connector. The third block is fitted in the insertion slot on one side thereof and sandwiches the first and second blocks to keep them joined together. At least one of the first and second blocks support a plurality of contacts arrayed in the longitudinal direction thereof and disposed respectively in guide grooves in the insertion slot. The contacts have free end portions held in resilient engagement with the third block and hence preloaded for reliable and stable electric contact with contacts of the companion connector inserted in the insertion slot. After the contacts are retained on the block or blocks, the first, second and third blocks are combined and assembled together.

8 Claims, 6 Drawing Figures

$18_2$
$11_B$
$26_n$
$27_n$
$31_{n-1}$
$15_n$
$14_n$
$46_n$
$47_n$
$32_{n-1}$
11
12
11b
13
12b
11a
12a
14p
30
46p
15p
47p
3
3
26p
27p
$26_2$
$31_2$
$32_2$
$14_2$
$27_2$
$15_2$
$46_2$
$47_2$
$14_1$
$46_1$
$15_1$
$31_1$
$47_1$
$32_1$
$18_1$
$26_1$
$11_A$
$27_1$ $47_n$
$46_n$
17
12
11
$47_2$
$46_2$
$47_1$
$46_1$

THREE-PIECE MULTICONNECTOR

BACKGROUND OF THE INVENTION

The present invention relates to a multiconnector having a multiplicity of contacts housed therein, and more particularly to such a multiconnector of a small size.

Multiconnectors of the type described comprise a body of insulating material in the form of a rectangular parallelepiped having a longitudinal slot for the insertion therein of a companion connector and a multiplicity of contacts arranged in an array in the slot. The body of the prior multiconnector has contact housings in the body, and the contacts and terminals thereof which are integrally shaped to contour are inserted respectively into the contact housings through a front face or a rear face of the body and retained securely therein. With this construction, the contacts are inserted one by one into their housings, a limitation which cannot reduce the overall size of the multiconnector to a large extent and prevents automatic fabrication of the multiconnector. When electric wires are to be soldered to the terminals, the flux tends to flow through terminal insertion holes into the body until they reach the contacts, whereupon electric contact with the mating connector can be impaired. One solution to the foregoing problem has been to apply an adhesive to the body to seal the terminals projecting from the body. However, this has required an increased number of processing steps for fabricating multiconnectors.

SUMMARY OF THE INVENTION

Accordingly, it is an object of the present invention to provide a multiconnector which can be constructed in small size.

Another object of the present invention is to provide a multiconnector which can be fabricated easily through automatic processing steps.

Still another object of the present invention is to provide a multiconnector which is constructed such that no flux will find its way up the contacts and which can be manufactured with ease.

According to the present invention, a multiconnector includes a body comprising first, second and third blocks, the first and second blocks being joined at ends to each other and jointly defining between the ends an insertion slot extending longitudinally of the blocks for insertion therein and removal therefrom a companion connector on a side of the body. The third block is fitted in and closes the insertion slot at a position opposite to the side of the body and has joint means assembling the first and second blocks together. At least one of the first and second blocks has a plurality of guide grooves on an inner surface thereof facing the insertion slot extending in the direction in which the companion connector can be inserted into and removed from the insertion slot, the guide grooves being arrayed in the longitudinal direction of the body. The guide grooves receive contacts respectively therein which are supported on the block having the guide grooves. The contacts have integral terminals projecting out of the block on which the contacts are supported. The contacts also have free end portions positioned in the insertion slots and held in resilient engagement with locking means on the third block so as to be resiliently urged in a direction away from the block on which the contacts are supported. When the companion connector is inserted in the insertion slot, the preloaded contacts are kept in resilient contact with contacts of the companion connector.

With the body composed of the first, second and third blocks, the contacts can be fabricated of electrically conductive resilient wires which are integrally molded in the first and/or second blocks and which are then bent simultaneously into the contacts and terminals. The blocks with the contacts thus mounted are combined together into a multiconnector. Accordingly, no tedious and time-consuming assembling procedure is necessary which would otherwise be the case with conventional preshaped contacts and terminals to be inserted and retained one by one in the body.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
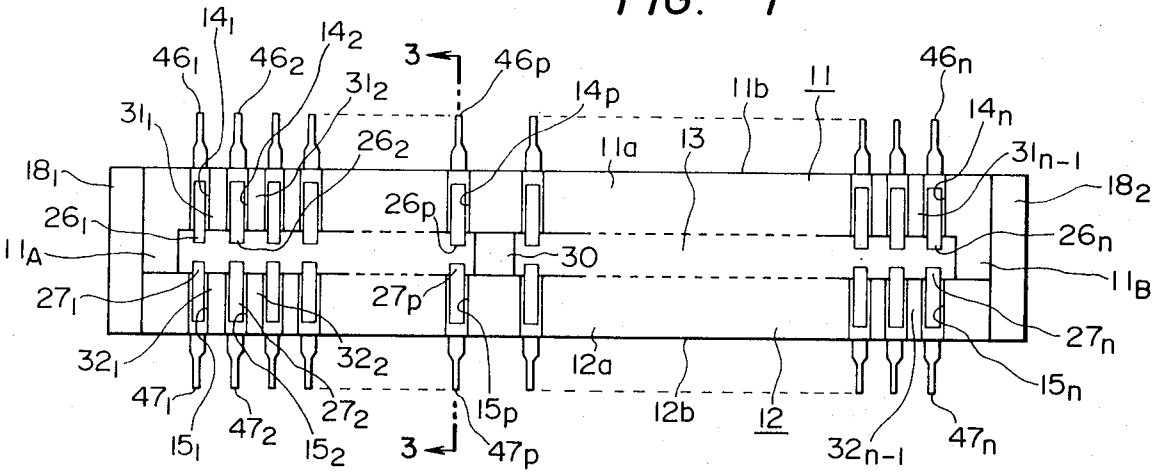
FIG. 1 is a plan view of a multiconnector according to the present invention.
Figure 2:
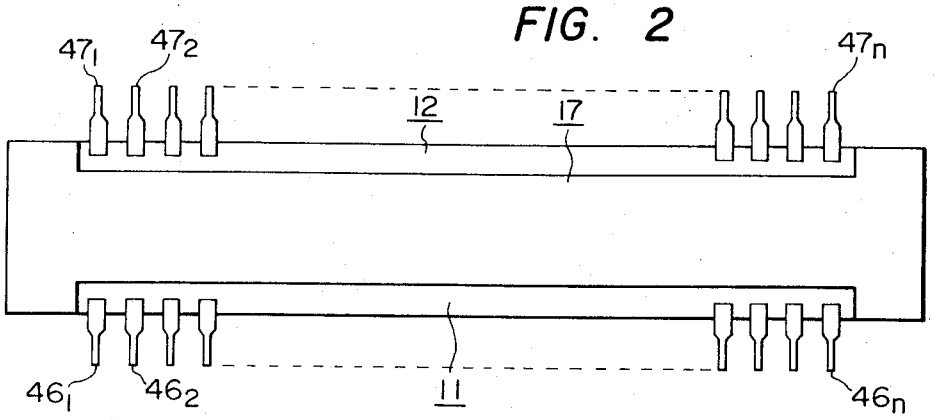
FIG. 2 is a bottom view of the multiconnector shown in FIG. 1.
Figure 5:
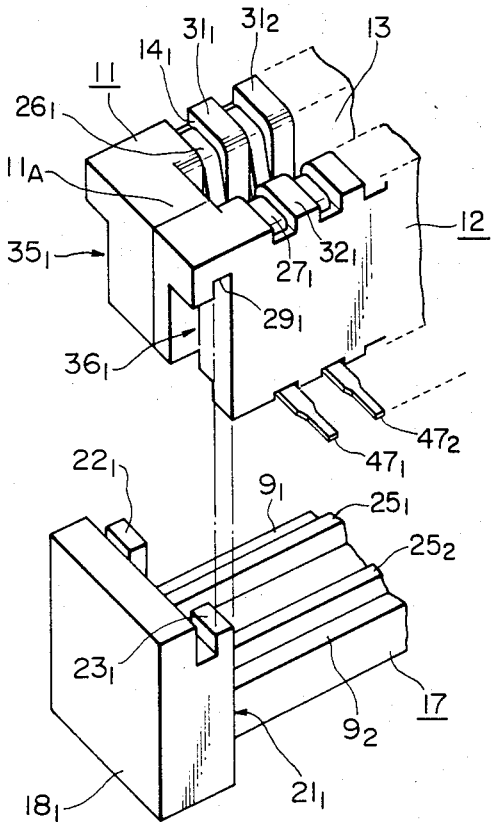
FIG. 5 is a fragmentary exploded perspective view of ends of first, second and third blocks of the multiconnector, showing means for joining these blocks together.

As shown in FIGS. 1 and 5, a multiconnector according to the present invention has a first block 11 of electrically insulating material such as synthetic resin substantially in the form of a rectangular parallelepiped. The first block 11 includes at its longitudinally opposite ends a pair of lateral projections 11A, 11B extending substantially perpendicularly to the plane of the first block 11 and in the same direction. The multiconnector also has a second block 12 as of synthetic resin substantially in the form of a rectangular parallelepiped having the same length as that of the first block 11. The second block 12 is held in abutment against the ends of the lateral projections 11A, 11B.

The first and second blocks 11, 12 thus put together in confronting relation jointly define therebetween a slot 13 (FIGS. 1, 3 and 5) extending longitudinally therealong for the insertion therein of a companion connector (not shown).

Figure 3:
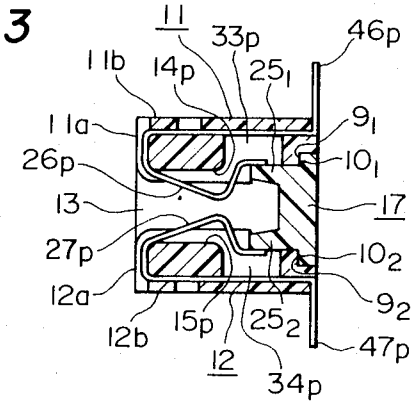
FIG. 3 is a cross-sectional view taken along line 3—3 of FIG. 1.

As illustrated in FIGS. 1, 3 and 5, the first and second blocks 11, 12 have therein guide grooves $\mathbf{14}_1$, $\mathbf{14}_2$, . . . $\mathbf{14}_n$, and guide grooves $\mathbf{15}_1$, $\mathbf{15}_2$, . . . $\mathbf{15}_n$, respectively, opening into the insertion slot 13 and extending in the direction in which the companion connector is to be inserted into or pulled from the insertion slot 13. Between adjacent ones of the grooves $\mathbf{14}_1$–$\mathbf{14}_n$ and $\mathbf{15}_1$–$\mathbf{15}_n$ are formed ribs $\mathbf{31}_1$–$\mathbf{31}_{n-1}$ and $\mathbf{32}_1$–$\mathbf{32}_{n-1}$ integrally with the first and second blocks 11, 12, respectively. The guide grooves $\mathbf{14}_1$, $\mathbf{14}_2$, . . . $\mathbf{14}_n$, and the guide grooves $15_1$, $15_2$, . . . $15_n$ are arranged in arrays in the longitudinal directions of the first and second blocks 11, 12 and held in confronting relation to each other. In FIG. 3, the guide grooves $14_1$–$14_n$, and the guide grooves $15_1$–$15_n$ respectively extend into front surfaces 11*a*, 12*a* of the first and second blocks 11, 12, and further reach outer side surfaces 11*b*, 12*b* of the first and second blocks 11, 12, respectively. Each of the guide grooves, represented by $14_p$ (also $15_p$) in FIG. 3, has a shallow portion substantially parallel to the direction of insertion of the companion connector and a deep portion more remote than the shallow portion from the front surface 11*a* (also 12*a*) where the groove is deepened toward the outer side surface 11*b* (also 12*b*) thereby forming a space $33_p$ (also $34_p$) which allows the free end portion of a contact $26_p$ (also $27_p$) to move toward the outer side surface 11*b* (also 12*b*) in accordance with the guide by the inner side walls of the adjacent ribs when the companion connector is inserted into the slot 13.

Figure 4:
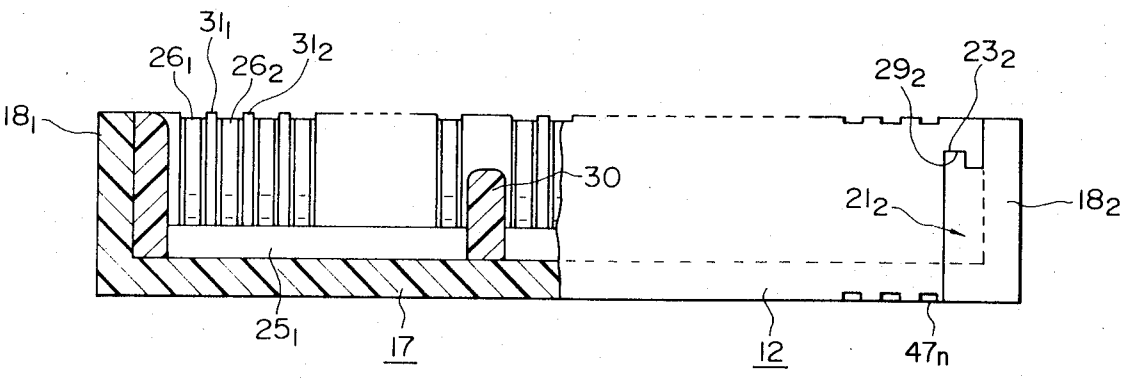
FIG. 4 is a front elevational view, partly cut away, of the multiconnector of FIG. 1.

The ends of the first and second blocks 11, 12 have in back corners thereof two pairs of recesses $35_1$, $35_2$, and $36_1$, $36_2$ (only $35_1$, $36_1$ are shown in FIG. 5), respectively, so that when the first and second blocks 11, 12 are abutted against each other there are formed T-shaped projecting lands at both ends. A third block 17 of electrically insulating material such as synthetic resin is fittably engaged with the abutted first and second blocks 11, 12 from rear surfaces of the first and second blocks 11, 12 which are remote from the front surfaces 11*a*, 12*a*. As shown in FIGS. 1, 4 and 5, the third block 17 has at its longitudinally opposite ends a pair of plate-like retainers $18_1$, $18_2$ projecting integrally perpendicularly from the plane of the third block 17 and in the same direction. The retainers $18_1$, $18_2$ include on their opposing inner surfaces two pairs of parallel guide projections $20_1$, $20_2$ and $21_1$, $21_2$ (only those of the retainer $18_1$ are shown in FIG. 5), respectively, which can fit respectively in the recesses $35_1$, $35_2$ and $36_1$, $36_2$ in the first and second blocks 11, 12. Furthermore, at the tops of the parallel guide projections $20_1$, $20_2$ and $21_1$, $21_2$ are provided locking projections $22_1$, $22_2$ and $23_1$, $23_2$ which are fitted, respectively, into locking slots $28_1$, $28_2$ and $29_1$, $29_2$ formed in the two wing portions of the T-shaped projecting lands at both end sides, thereby preventing the retainers $18_1$, $18_2$ from departing from the abutted first and second blocks 11, 12 outwardly. The third block 17 also has a pair of parallel locking ridges $25_1$, $25_2$ formed integrally on and extending longitudinally along the surface of the third block 17 which lies between the retainers $18_1$, $18_2$. The locking ridges $25_1$, $25_2$ are laterally spaced from each other by a distance substantially equal to the width of the insertion slot 13. As shown in FIG. 3, the locking ridges $25_1$, $25_2$ are fitted in the insertion slot 13 as it is spread at the rear sides of the first and second blocks 11, 12. The first and second blocks 11, 12 have rear steps $10_1$, $10_2$, respectively, held in engagement with shoulders $9_1$, $9_2$, respectively, of the third block 17 which are located behind the locking ridges $25_1$, $25_2$ respectively.

Two groups of contacts $26_1$ through $26_n$ and $27_1$ through $27_n$ that are made of resilient electrically conductive material in the form of thin webs are disposed respectively in the guide grooves $14_1$ through $14_n$ and $15_1$ through $15_n$ in first and second blocks 11, 12. The contacts $26_1$ through $26_n$ and $27_1$ through $27_n$ respectively represented by $26_p$ and $27_p$ in FIG. 3 have front portions extending outwardly around the front surfaces 11*a*, 12*a* of the first and second blocks 11, 12, bent and buried under the outer side surfaces 11*b*, 12*b*, and projecting through the first and second blocks 11, 12 out beyond the rear surfaces thereof. The projecting ends of the contacts are then bent outwardly at a right angle into terminals $46_1$ through $46_n$ and $47_1$ through $47_n$, represented by $46_p$ and $47_p$ respectively.

Figure 6:
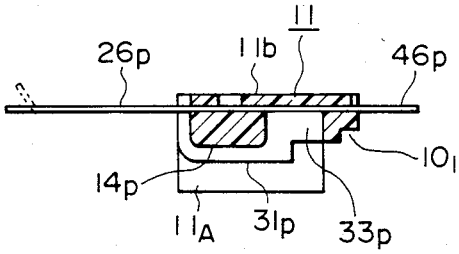
FIG. 6 is a cross-sectional view illustrative of the manner in which a contact and a terminal are being supported on the first block.

For assembly, as shown in FIG. 6, each of the contacts $26_1$ through $26_n$ can be shaped by integrally molding a straight contact $26_p$ (p=1, 2, . . . n) with a terminal $46_p$ in the block 11, and then bending a front projecting portion of the contact $26_p$ along and in a corresponding guide groove $14_p$ to thereby form the bent contact $26_p$. The bent contact $26_p$ forms an angle with respect to the surface of the shallow portion of the guide groove $14_p$ so as to depart therefrom as the distance from the front surface 11*a* increases and is bent inwardly into the space $33_p$. The free end portion of the contact $26_p$ is further bent to direct it to the third block 17. Before the molding, a front end of the contact $26_p$ may be bent in advance as shown by the dotted lines in FIG. 6; thereafter, the front projecting portion of the contact $26_p$ is urged against the contour of the corresponding guide groove $14_p$ and released to form the abovementioned shape of the contact $26_p$ as seen in FIG. 3 owing to the resiliency of the contact. Likewise, each of the contacts $27_1$ through $27_n$ can be formed by bending a contact $27_p$ into desired contour and retaining the same in place. The blocks 11, 12 with the contacts $26_1$ through $26_n$ and $27_1$ through $27_n$ mounted thereon are put together as the block 12 is held against the ends of the laterial projections 11A, 11B. The locking ridges $25_1$, $25_2$ of the third block 17 are fitted into the insertion slot 13 defined between the first and second blocks 11, 12, with the locking projections $20_1$, $21_1$ on the retainers $18_1$, $18_2$ being fitted respectively in the recesses $35_1$, $36_1$ in the first and second blocks 11, 12. The first, second and third blocks 11, 12, 17 are thus assembled together. As assembled, the first and second blocks 11, 12 are sandwiched endwise between the guide projections $20_1$, $21_1$ on the retainers $18_1$, $18_2$. The mating surfaces of the blocks 11, 12, 17 can completely be joined together by, for example, ultrasonic welding.

When the first, second and third blocks 11, 12, 17 are combined together, the contacts $26_1$, $27_1$; $26_2$, $27_2$; . . . have their free ends spread away from each other by the locking ridges $25_1$, $25_2$ positioned therebetween, so that the free ends of the contacts $26_1$ through $26_n$ and $27_1$ through $27_n$ are resiliently held against the locking ridges $25_1$, $25_2$. The guide grooves $14_p$, $15_p$ (p=1, 2, . . . n) extend toward the outer side surfaces 11*b*, 12*b* of the first and second blocks 11, 12 to allow the free ends of the contacts $26_p$, $27_p$ to be spread away from each other by the locking ridges $25_1$, $25_2$.

As illustrated in FIGS. 1 and 4, the insertion slot 13 has a projection 30 which may be formed integrally with the first block 11, for example. The projection 30 is spaced different distances from the opposite ends of the insertion slot 13, and the companion connector has a recess positioned correspondingly to the projection 30 to receive the same. Therefore, the companion connector cannot be inserted into the insertion slot 13 when the companion connector is inverted or turned up side down, thereby preventing improper electric connection between the multiconnector of the invention and the companion connector.

With the multiconnector thus constructed, the two groups of contacts $26_1$ through $26_n$ and $27_1$ through $27_n$ are supported respectively on the first and second blocks 11, 12 and the insertion slot 13 is defined when the first and second blocks 11, 12 are put together. The contacts $26_1$ through $26_n$ and $27_1$ through $27_n$ can be molded in the first and second blocks 11, 12. The contacts are spaced at smaller intervals and hence the multiconnector is smaller in size than would be the case if the contacts were inserted respectively into small holes in the connector body as is conventional. Where the first and second blocks are molded around the contacts with the terminals, the free ends of the terminals may be interconnected by a connector arm extending perpendicularly to the terminals, so that the terminals can stably be retained in the mold to facilitate the molding operation. The contacts thus molded in the blocks are then bent to desired profile simultaneously, and the blocks are assembled together, all in an automatic process. Although the contacts and their terminals have been described as being molded in the blocks 11, 12, the contacts $26_p$, $27_p$ may be formed in an alternative procedure by inserting electrically conductive resilient wires respectively through small holes in the blocks 11, 12 in a manner as shown in FIG. 6, and bending the inserted wires simultaneously into the contacts $26_p$, $27_p$ in an automatic assembling operation. The foregoing process can produce a smaller multiconnector than prior multiconnectors having preshaped contacts and terminals inserted and held in connector bodies.

Since the free ends of the contacts $26_1$ through $26_n$ and $27_1$ through $27_n$ are resiliently held against the locking ridges $25_1$, $25_2$ and hence are preloaded, the corresponding contacts of the companion connector inserted in the slot 13 can be held in contact with the contacts $26_1$ through $26_n$ and $27_1$ through $27_n$ under sufficient pressures of contact. With the ends of the lateral projections 11A, 11B of the first block 11 being joined to the second block 12 and the first and second blocks 11, 12 being sandwiched in position endwise between the retainers $18_1$, $18_2$ of the third block 17, the insertion slot 13 has a constant width which permits the companion connector to contact the multiconnector under constant pressure. In case the contacts $26_1$ through $26_n$ and $27_1$ through $27_n$ with their terminals $46_1$ through $46_n$ and $47_1$ through $47_n$ are integrally molded in the blocks 11, 12, there is no danger that any flux used when soldering wires to the terminals will leak along the contacts into the insertion slot 13, with the result that good electric contact will be ensured between the contacts of the multiconnector and those of the companion connector.

While in the illustrated embodiment the contacts $26_1$ through $26_n$ and $27_1$ through $27_n$ are mounted respectively on the first and second blocks 11, 12, either the contacts $26_1$ through $26_n$ or $27_1$ through $27_n$ may be attached to either the first block 11 or the second block 12.

Although a certain preferred embodiment has been shown and described, it should be understood that many changes and modifications may be made therein without departing from the scope of the appended claims.

What is claimed is:

1. A multiconnector comprising:

a first block of electrically insulating material substantially in the form of a rectangular parallelepiped;

a second block of electrically insulating material parallel to and in engagement with said first block to define therebetween an elongated insertion slot adapted to receive a removable companion connector at a front opening of said insertion slot;

an elongated third block of electrically insulating material fitted into said insertion slot to close the portion of said insertion slot opposite to said front opening;

joint means formed at both ends of said elongated third block integrally therewith for fixedly holding said first and second blocks therebetween;

said first block having an array of guide grooves formed in an inner wall surface thereof and extending parallel to one another in a direction transverse to the direction of elongation of said insertion slot;

a plurality of resilient conductors disposed parallel to one another adjacent respective ones of said guide grooves, a center portion of each of said conductors being buried by molding in at least a portion of said first block near the front opening of said insertion slot, one end portion of each of said conductors projecting outwardly from said first block and being folded to confront a corresponding one of said guide grooves thereby to form a contact portion, and the other end portion of each of said conductors projecting outwardly from said first block to form a terminal portion; and locking means formed on said third block integrally therewith and extending parallel to said first block, said locking means being positioned to engage the free end of said one end portion of each of said conductors so as to cause the resilient force exerted by said conductors to urge said contact portions away from said first body.

2. A multiconnector according to claim 1 wherein said second block has an array of second guide grooves formed in an inner wall surface thereof and extending parallel to one another in a direction transverse to the direction of elongation of said insertion slot and in confronting relation to the guide grooves in said first block; said multiconnector further comprising a plurality of second resilient conductors disposed parallel to one another adjacent respective ones of said second guide grooves, a center portion of each of said second conductors being buried by molding in at least a portion of said second block near the front opening of said insertion slot, one end portion of each of said second conductors projecting outwardly from said second block and being folded to confront a corresponding one of said second guide grooves thereby to form a second contact portion, and the other end portion of each of said second conductors forming a second terminal portion, and second locking means formed on said third block integrally therewith to extend parallel to the first-mentioned locking means, said second locking means being positioned to engage the free end of said one end portion of each of said second conductors so as to cause the resilient force exerted by said second conductors to urge said second contact portions away from said second block.

3. A multiconnector according to claim 1 wherein said contact portions of said conductors project away from a front face of said first body, said guide grooves extending into the front face of said first body to respective positions where the buried center portions of said conductors emerge from said first body.

4. A multiconnector according to claim 1 or 2, wherein said joint means comprises first and second retainers extending substantially perpendicularly from said third block in the same direction, said first and second retainers having integral guide projections on opposite side surfaces, the opposite ends of said first and second blocks having outer corner recesses, said first and second blocks being joined to said third block with said guide projections fitted respectively in said outer corner recesses and sandwiching said ends of said first and second blocks.

5. A multiconnector according to claim 2, wherein said two locking means comprise a pair of locking ridges disposed on and extending longitudinally along said third, block, said locking ridges being laterally spaced from each other by a distance substantially equal to a width of said insertion slot.

6. A multiconnector according to claim 1 or 2, wherein said first, second and third blocks have joint faces secured together.

7. A multiconnector according to claim 6, wherein said joint faces are joined by ultrasonic welding.

8. A multiconnector according to claim 1 or 2, wherein one of said first and second blocks has on ends thereof a pair of integral lateral projections extending toward the other block and having ends joined to said other block, said insertion slot having a width determined by the length of said lateral projections.

* * * * *